US005956824A

United States Patent [19]

Redman et al.

[11] Patent Number: 5,956,824

[45] Date of Patent: Sep. 28, 1999

[54] EQUIPMENT FOR USE IN BATHS DISPOSED WITHIN MOLTEN METAL PLATING BATHS

[75] Inventors: Charles F. Redman, Plaistow, N.H.; Donnie J. Thompson, Greensboro, N.C.

[73] Assignee: Redman Card Clothing Co., Inc., Andover, Mass.

[21] Appl. No.: 08/908,037

[22] Filed: Aug. 11, 1997

[51] Int. Cl.[6] ..... D06C 11/00; D06C 13/08

[52] U.S. Cl. ..... 26/31; 26/32; 26/28

[58] Field of Search ..... 26/28, 29 R, 31, 26/32, 33, 37, 2 R, 7, 8 R, 9, 8 C; 19/114; 28/115, 162

[56] References Cited

U.S. PATENT DOCUMENTS

| | | | |
|---|---|---|---|
| 394,747 | 12/1888 | Wolcott | 26/28 |
| 1,218,131 | 3/1917 | Tomlinson | 26/28 |
| 1,411,071 | 3/1922 | Tomlinson | 26/28 |
| 1,622,893 | 3/1927 | Walker | 26/31 |
| 2,937,412 | 5/1960 | Hollingsworth | 19/114 |
| 3,175,224 | 3/1965 | Bertrand | 26/33 |
| 3,683,559 | 8/1972 | Kalwaites | 26/28 |
| 4,467,505 | 8/1984 | Mitsuyoshi | 26/33 |
| 4,512,065 | 4/1985 | Otto | 26/37 |
| 4,771,659 | 9/1988 | Schmolke | 76/1 |
| 5,084,948 | 2/1992 | Nielsen et al. | 26/32 |
| 5,109,630 | 5/1992 | Love et al. | 26/28 |
| 5,392,499 | 2/1995 | Bertoldo | 26/28 |
| 5,588,192 | 12/1996 | Bertoldo et al. | 26/31 |

FOREIGN PATENT DOCUMENTS

| | | | |
|---|---|---|---|
| 2740 | of 1855 | United Kingdom | 26/32 |

*Primary Examiner*—Amy B. Vanatta
*Attorney, Agent, or Firm*—Pearson & Pearson

[57] ABSTRACT

A method and apparatus for providing a soft finish on a fabric such as a suede tone, raised loops, broken loops or fleeced and for providing a faded effect such as a washed or faded denim. A fillet having a plurality of wires extending therefrom is wound on a cylinder of a finishing machine. The outer ends of the wires extending from the fillet are angled at approximately 80° from vertical. The wires are covered with an abrasive coating which is applied by an arc spray system. The coating extends around the perimeter of the wire from at least just below the bend of the wires and extending to the outer tip of the wires. The fabric is driven over a nip roll that is adjusted to bring the fabric in closer contact with the wires on the cylinder which is rotating. An alternative embodiment of accomplishing the same type of soft finish such as suede or washed or faded denim finish is accomplished with multi rolls (or kiss rolls) finish machinery using the coated wire fillet on each roll. The wires of fillets for napping machines are similarly covered with the abrasive coating for achieving a more efficient operation on a napper finishing machine.

35 Claims, 7 Drawing Sheets

EQUIPMENT FOR USE IN BATHS DISPOSED WITHIN MOLTEN METAL PLATING BATHS

BACKGROUND OF THE INVENTION

1. Field of the Invention

This invention relates to methods and apparatus for providing surface finishes on fabrics and in particular to an abrasive coated wire for surface finishing fabrics to have raised loops, broken loops, fleeced or suede finishes.

2. Description of Related Art

A common method of producing suede fabric is to use a finishing machine having a rotating cylinder. A coated abrasive such as sandpaper is wrapped around the cylinder. The finishing machine cylinder is brought in contact with a fabric as it passes through the machine producing a suede finish. However, debris from the sueding process packs into the sandpaper, and the sandpaper has to be changed frequently. Frequent changes of sandpaper create expensive down time during which time no fabric is being finished by the machine.

In the prior art, a napping machine is described in U.S. Pat. No. 3,175,224, issued Mar. 23, 1965 to Charles Bertrand. This machine uses two napping rolls as a rotating cylinder. One of the napping rolls comprises numerous wires or pins mounted in a fabric base having hooked shaped ends. The hooked pins draw through the surface of the fabric, such as blanket cloth, to produce a markedly high nap. The other napping roll commonly known as the counterpile roll normally comprises wire having straight points at the ends of the wires. However, this patent discloses wires having flattened, knife-like or chisel-like ends for tucking or smoothing the wild of teasled fibers resulting from the action of the hook shaped wires. Further, this patent does not disclose coating such as wires to achieve improved performances.

In U.S. Pat. No. 2,937,412, issued May 24, 1960 to John D. Hollingsworth, a carding tooth is disclosed for carding and opening textile fiber stocks such as cotton, wool, synthetics, etc. Round wire is cut to required length and shaped to generally U-shaped form with angularly offset extremities. Each U-shaped wire is set in a flexible foundation consisting equally of a number of plies of cloth. This patent teaches that roughening the side surface of the wire teeth improves carding or fiber opening operation. However, this procedure has not been adopted by the trade. In fact, it is common knowledge that rough edges on card wire are a negative in the carding operation.

The roughening of the side surfaces may be produced by scoring the wire with a grinding wheel of 40 grit in crisscross design. The wheel being allowed to touch the wire only to the extent of producing the scored and roughened surface. Hollingsworth further discloses that the roughened effect was practically achieved with hard chromium plating on slightly rough wire surfaces, the plating magnifying the original roughness in its tendency to deposit on the high peaks and thereby to accentuate the roughness of the surfaces. Hollingsworth also discloses a like result obtained by spraying metal on the surfaces of the wire to obtain a surface having a pronounced roughness for carding operations. Although Hollingsworth states that the roughening of the teeth (or wire) was found to effect a pronounced improvement in the carding function, this has not been found to be true by those skilled in the carding business. Further, this patent does not teach a method of providing a soft finish on a fabric using a metal coated wire.

In U.S. Pat. No. 4,467,505, issued Aug. 28, 1984, to Toru Mitsuyoshi et al., and assigned to Hiroyuki Kanai of Ashiya, Japan, raising machine wire clothing is described having wires on counter pile rollers of substantially diamond-shape cross-sections of four equal sides enclosing two obtuse and two acute angles and a radius of less than 0.1 mm at the acute angle corners of the cross-section of the wires. Wires on the pile rollers have a circular cross-section. By the use of the set of rollers on a raising machine, short piles drawn out by the clothing of the pile rollers are cut by the clothing of the counter pile roller such that a suede tone finish of the short pile and high density can be produced. The density of the wire points on the foundation cloth is within the range of 150–500 points per square inch. Another embodiment of the wire for counter pile rollers can be of a type having a cross-section which is either elliptical or sector shaped. Another embodiment of the wire for the pile rollers can be of a type having elliptical cross-sections. However, this patent does not disclose a metal coated wire for producing more efficiently a suede tone finish.

SUMMARY

Accordingly, it is therefore an object of the invention to provide a cost effective, efficient method and apparatus for obtaining various pile surfaces on fabrics produced on finishing machines employing coated wire fillets such as a suede finishing machine and a napper finishing machine.

It is another object of the invention to provide a method for obtaining a soft finish on a fabric such as a suede tone finish using a coated wire fillet in a finishing machine.

It is another object of the invention to provide a method for obtaining a faded effect on a fabric such as a washed or faded denim using a coated wire fillet in a finishing machine.

It is a further object of the invention to provide a method for obtaining a raised loop pile surface on a fabric using a coated wire fillet in a finishing machine.

It is yet another object of the invention to provide a method for obtaining a broken loop pile surface on a fabric using a coated wire fillet in a finishing machine.

It is another object of the invention to provide a method for obtaining a fleeced surface on a fabric using a coated wire fillet in a finishing machine.

It is a further object of the invention to provide a finishing machine having a driven roll operating in a clockwise direction and a cylinder operating in a counterclockwise direction having a coated wire fillet attached thereto for providing a soft finish to a fabric when passed between the driven roll and the cylinder such as a suede finish.

It is a further object of the invention to provide a finishing machine having a driven roll operating in a clockwise direction and a cylinder operating in a counterclockwise direction having a coated wire fillet for providing a soft washed or faded finish to a denim fabric when passed between the driven roll and the cylinder.

It is yet another object of the invention to provide a finishing machine having a plurality of rolls, each of the rolls having a coated wire fillet for producing gradual control of a predetermined suede finish on a fabric.

These and other objects are accomplished by a method for providing a soft finish on a fabric comprising the steps of feeding a fabric into a finishing machine, moving the fabric over a first driven means rotating in a first direction, providing a second driven means rotating in a second direction adjacent to the first driven means, attaching an abrasively coated wire means to the second driven means, adjusting the moving fabric to be in contact with the abrasively coated wire means, and cutting surface fibers of the fabric with the abrasively coated means as the fabric passes between the first driven means and the second driven means. The step of feeding a fabric into a finishing machine includes the step of providing tension on the fabric for constant surface contact with the abrasively coated wire means. The step of moving the fabric over the first driven roller means includes the step of covering the first driven means with a rubber face foundation to provide a frictional, cushioned surface. The step of cutting surface fibers of the fabric with the abrasively coated wire means comprises the step of providing each wire of the wire means with a tungsten carbide coating. The step of attaching an abrasively coated wire means to the second driven means includes the step of attaching a fillet around the second driven means having a plurality of abrasively coated wires extending through a flexible base. The fabric exiting from the finishing machine comprises a suede finish. The step of feeding a fabric into a finishing machine includes the step of feeding a denim fabric into the finishing machine for producing a soft, washed or faded finish.

The objects are further accomplished in a finishing machine for producing a soft finish on a fabric having an improvement comprising first driven means for drawing the fabric into the finishing machine, and second driven means, positioned adjacent to the first driven means, for providing a finishing means, the finishing means comprises an abrasively coated wire means attached thereto for producing the soft finish on the fabric. The abrasively coated wire means comprises a fillet having a plurality of wires, each of the wires being coated with a tungsten carbide coating.

The objects are further accomplished by a method of using wires for raising pile surfaces on a fabric in a finishing machine comprising the steps of providing a fillet having a plurality of the wires extending from a flexible base, each of the wires having an angularly offset extremity, coating the wires with an abrasive material, and attaching the abrasively coated wire fillet to the machine for finishing fabric with the pile surfaces on the fabric. The method comprises the step of providing each of the abrasively coated wires with a round profile. The method includes producing a suede surface on the fabric. The step of providing each of a fillet having a plurality of wires comprises the step of providing the angularly offset extremity with a slant angle of approximately eighty degrees. The step of coating the wires extending from the fillet comprises the step of spraying a tungsten carbide material on the wires. The method comprises the step of providing the abrasively coated wires with a predetermined geometric profile for obtaining a predetermined pile surface on the fabric. The step of providing the abrasively coated wires having a predetermined geometric profile for obtaining a predetermined pile surface on the fabric comprises the step of raising loops on the fabric, the step of breaking loops on the fabric, or the step of producing a fleeced finish on the fabric.

The objects are further accomplished in a finishing machine for raising a pile surface on a fabric, having an improvement comprising a fillet having a plurality of wires extending from a flexible base, each of the wires having an angularly offset extremity, each of the plurality of wires having an abrasive material coated thereon, roll means for providing a surface for wrapping the fillet around, and means for drawing and positioning an unfinished fabric in contact with the abrasively coated wire fillet to produce the pile surface. Each of the plurality of wires has a round profile. The produced pile surface on the fabric comprises a suede finish. Each of the plurality of wires in the fillet comprises the angularly offset extremity with a slant angle of approximately eighty degrees. Each of the abrasive material coated wires comprises a coating of tungsten carbide material. The finishing machine may be a suede or a napper finishing machine depending on the desired finish. The plurality of abrasively coated wires comprises a predetermined geometric profile for obtaining the pile surface on the fabric. The pile surface on the fabric comprises raised loops, broken loops or a fleeced finish.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

FIG. 5(*b*) is a cross section on an enlarged scale of the coated wire shown in FIG. 5(*a*).

DESCRIPTION OF THE ILLUSTRATIVE EMBODIMENTS

Figure 1:
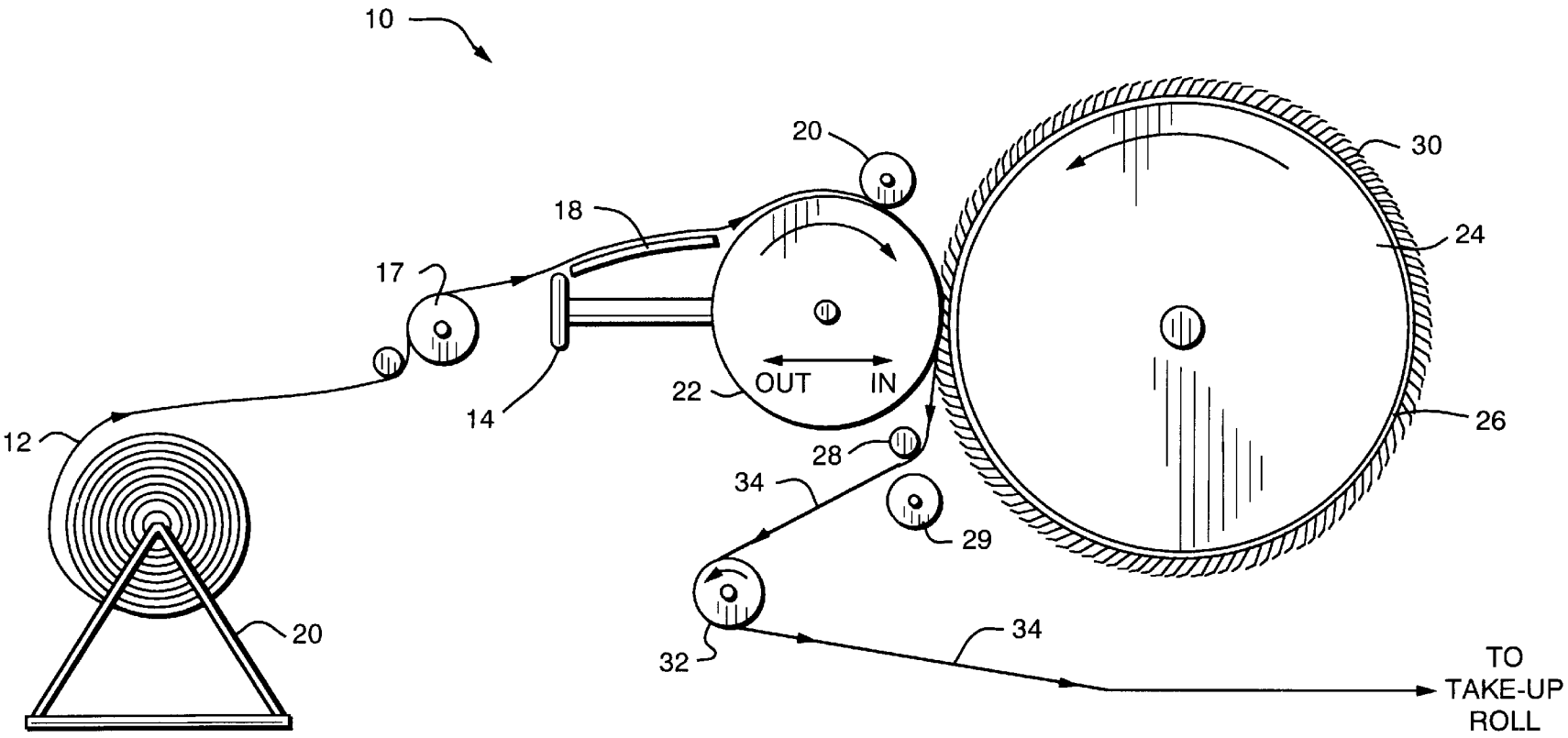
FIG. 1 illustrates a preferred embodiment of a finishing machine according to the invention.

Referring now to FIG. 1, a preferred embodiment of the invention is illustrated employing a fabric finishing machine 10. A roll of fabric 12 to be processed is mounted on a let-off stand 20 for feeding into the finishing machine 10, or the fabric 12 may come out of a tub (not shown). The finishing machine 10 comprises a driven rubber roll 22 operating in a clockwise direction and a cylinder 24 operating in a counterclockwise direction. The cylinder 24 is covered with a wire fillet 26 and each of the wires 30 extending from the fillet 26 comprises an abrasive coating 27 described below.

The fabric 12 is fed around a tension roller 17 over a workboard 18 and then between a pinch roll 20 and the rubber roll 22. The unfinished fabric 12 then proceeds between the driven rubber roll 22 which turns clockwise and the wire fillet 26 mounted on the cylinder 24 which turns counterclockwise. As the fabric 12 exits from the driven roll 22 and the cylinder 24 it passes between a guide 28 and cleaning brush 29 for removal of fabric debris. The finished fabric 34 then passes around an exit driven roll 32 for moving the finished fabric 34 out of the machine 10 to a take-up roll (not shown). The unfinished fabric 12 exits the machine 10 as finished fabric 34 having a soft finish such as suede, or when the unfinished fabric 12 is denim, exits the machine 10 having a washed or faded finish.

There is a handwheel 14 coupled to the rubber roll 22 on the finishing machine 10 which works in cooperation with the driven rubber roll 22 for adjusting the space between the roll 22 and cylinder 24 by moving the rubber roll 22 in and out relative to cylinder 24. This adjustment is important because it permits variations in the finish of the fabric 12 passing through the finishing machine 10.

Fabric with a suede finish has previously been obtained by the use of sandpaper wrapped around the cylinder 24. However, as the unfinished fabric comes in contract with the sandpaper particles of the fabric are removed and tend to build up on the sandpaper causing the sandpaper to become ineffective. Hence, the sandpaper has to be replaced at frequent intervals in order to continue to obtain a satisfactory suede finish, resulting in considerate finishing machine down time. The finishing machine 10 of FIG. 1 significantly reduces the down time of the finishing machine 10 resulting in greater output of finished fabric.

The finishing machine 10 may be embodied by a 710 Series finishing machine, modified in accordance with this invention, manufactured by Curtin-Hebert Company, Inc., of Gloversville, N.Y. The wire fillet 26 for the cylinder 24 in the finishing machine 10 may be embodied by Model F100 manufactured by Redman Card Clothing Company, Inc. of Andover, Mass.

Figure 2:
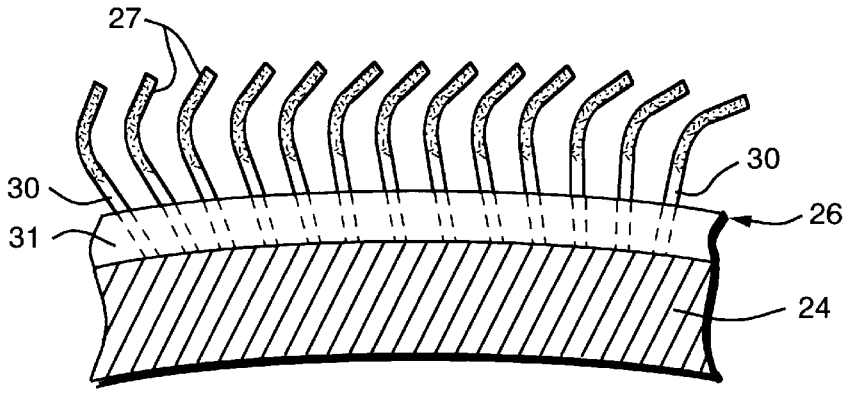
FIG. 2 is a fragmentary sectional view of a cylinder equipped with a fillet having wires protruding therefrom, the ends of the wires being angled significantly from vertical.
Figure 3:
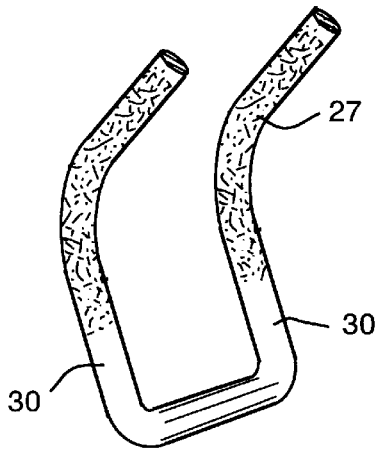
FIG. 3 is a view in perspective and an enlarged scale of a form of the wires adapted for use in a fillet made in accordance with the invention.
Figure 5A:
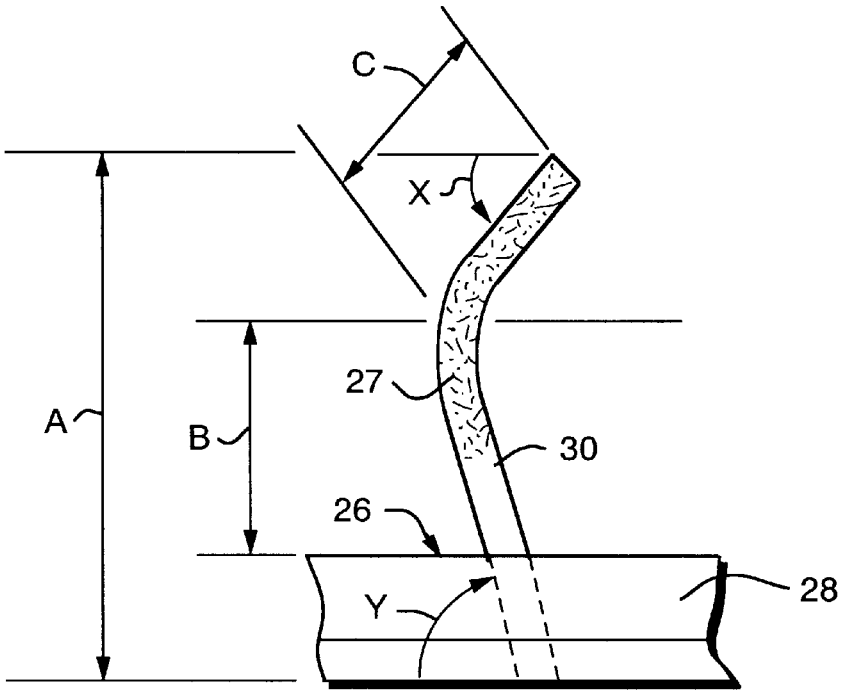
FIG. 5(*a*) is a side view of an enlarged coated wire extending from a fillet for use in a finishing machine according to the invention.

Referring to FIG. 2 and FIG. 3, FIG. 2 is a fragmentary sectional view of a cylinder 24 having attached thereto a fillet 26 with a plurality of coated wires 30 protruding therefrom. The end tips of the wires 30 are angled approximately 35 degrees from horizontal (see angle X in FIG. 5*a*). FIG. 3 is a perspective view of an enlarged U-shaped staple providing two wires 30 when inserted into the fillet 26. The angled ends of the staple wires 30 are formed after insertion into the base 31 of the fillet 26. Every angled end of the wires 30 extending from the fillet 26 is coated with an abrasive coating 27 such as tungsten carbide or other similarly hard material. The coating extends from the outer tips of the wires to below the bend and around the perimeter of each wire 30.

Figure 4:
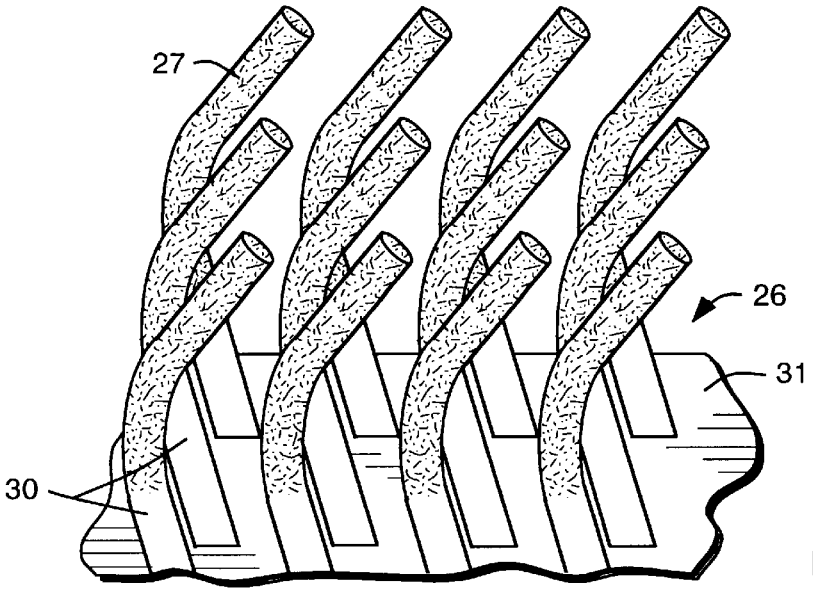
FIG. 4 is a view in perspective and in enlarged scale of a portion of the coated wires extending from a fabric base forming a fillet in accordance with the invention.

Referring to FIG. 4, an enlarged scale perspective view of a plurality of coated wires 30 extending from the base 31 of a portion of a fillet 26 is shown. The staples as shown in FIG. 3 are inserted into the base 31 to produce a densely populated wire fillet 26. The coating 27 such as the tungsten carbide coating is applied to the wires 30 of the densely populated fillet 26. The density of the wire points in the fillet 26 varies depending on the fabric being finished and the type of finish. Typically for a suede finish the density is 528 points per square inch.

Figure 5B:
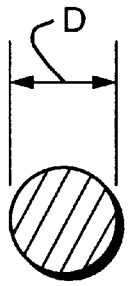

Referring now to FIG. 5(*a*) and FIG. 5(*b*), FIG. 5(*a*) is a side view of an enlarged coated wire 30 extending through and above the base 31 of a fillet 26. FIG. 5(*b*) shows a cross-section of the wire in FIG. 5(*a*) which is round. The specifications for the wires 30 of fillet 26 are defined in the following table and these specifications may be varied depending on the fabric and the desired finish:

TABLE 1

| SPECIFICATIONS OF WIRE FOR FILLET | |
|---|---|
| PITCH OR ANGLE OF WORKING (X): | 35 Degrees |
| SLANT OR ANGLE OF SETTING (Y): | 80 Degrees |
| HEIGHT OF WIRE (A): | 0.280 inches |
| HEIGHT OF BEND (B): | 5/64 inches |
| LENGTH OF ANGLED END (C): | 5/64 inches |
| DIAMETER OF WIRE (D): | 0.011 inches |
| CROSS-SECTIONAL SHAPE OF WIRE: | Round |
| DENSITY OF WIRE POINTS: | 528 points per square inch |

Figure 6:
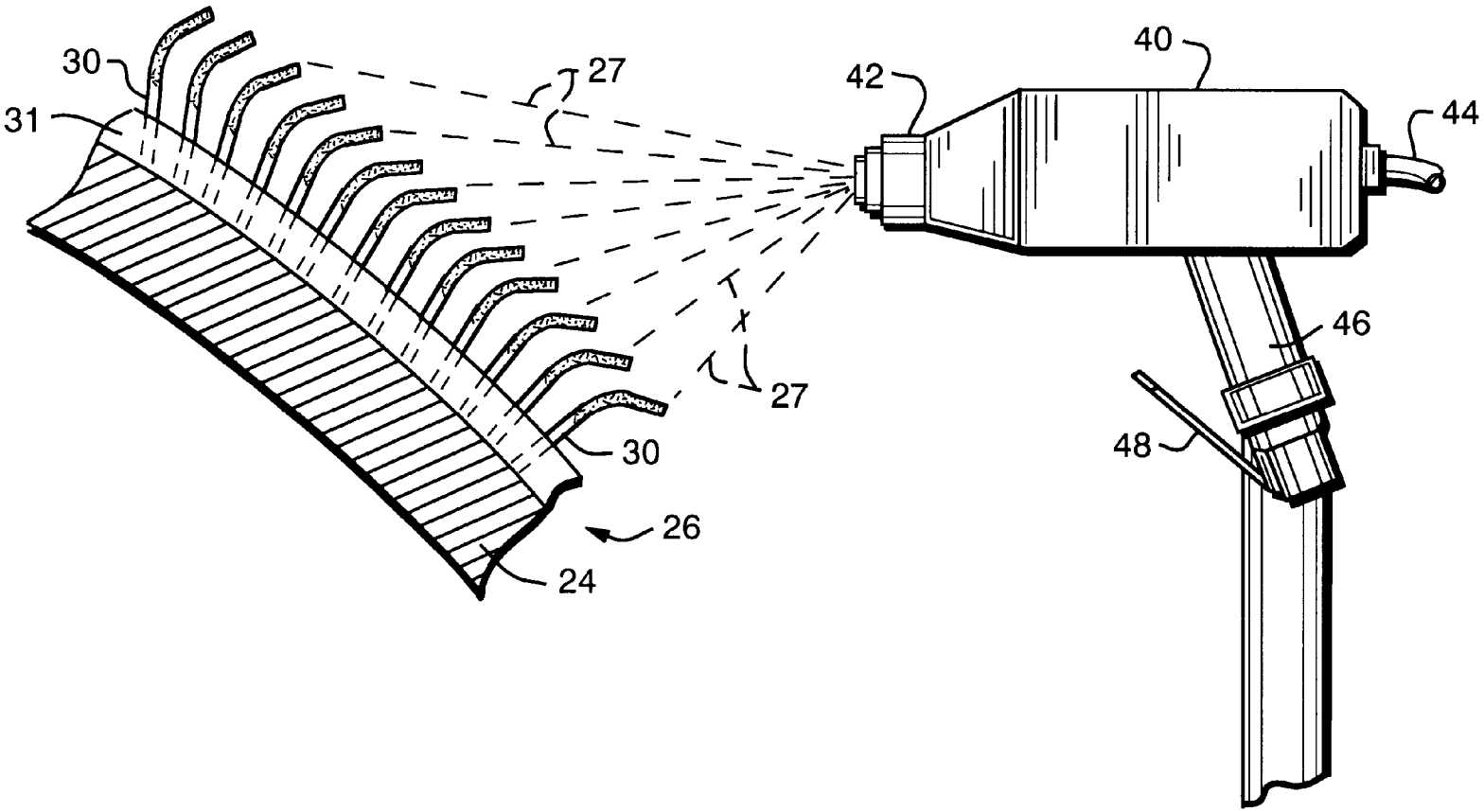
FIG. 6 illustrates an arc spray gun applying an abrasive coating to the wires of a fillet.

Referring now to FIG. 6, a preferred method of coating the wires 30 is by the use of an arc spray system. An arc spray gun 40 is loaded with a feed wire 44, and the wire for this embodiment is made of elements including tungsten carbide or other similarly hard materials. The correct voltage setting is set along with amperage and air pressure, as recommended by the air spray gun 40 manufacture, which controls the spray rate. The thermal spray wire 44 utilizing tungsten carbide or other hard materials within an amorphorous matrix is used to provided excellent abrasion resistance. The coating 27 provides not only an abrasive quality, but improved wear resistance over conventional means. A coating of approximately 0.002 inches thick is applied to the wires 30 of the fillet 26, and the spray gun is positioned approximately 7.25 inches from the end of the wires 30. The spray gun 40 parameters are as follows:

CLEAR NOZZLE CAP, SLOTTED NOZZLE, 50 PSI AIR, 100 AMPS, 7.25" STANDOFF SPRAYED INTO WIRE POINTS, and 0.5 ON SPEED DIAL; (for approximately 3'–5' per minute fillet travel speed).

Prior to coating, the feed wire 44 is cleared of oils and dirt to insure a good mating. This can be accomplished by passing the wires 44 through an alcohol bath.

Other methods which create an abrasive, wear resistant surface to the wire 30 may be equally applicable such as other thermal sprays, mechanical roughening combined with hardening treatment for wear resistance. Another technique of coating the wires 30 with an abrasive material such as by electroplating may be used.

The arc spray system including the gun 40, control console and power supply (not shown) may be embodied by Model 8830 manufactured by TAFA, INC. of Concord, N.H. The tungsten carbide feed wire 44 may be embodied by 97 MXC manufactured by TAFA, Inc. of Concord, N.H. The feed wire 44 may also be embodied by Model 95 MXC comprising silicon chromium, manganese, boron and iron also manufactured by TAFA, Inc. of Concord, N.H.

Figure 7:
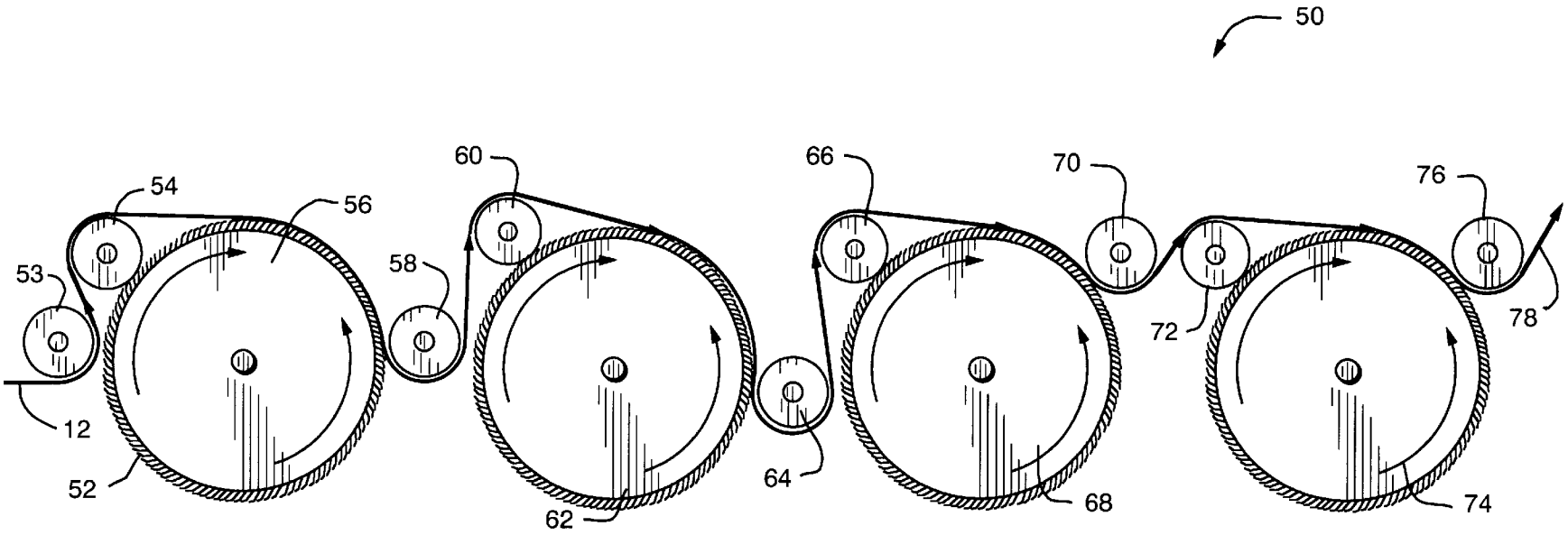
FIG. 7 illustrates an alternate embodiment of a finishing machine employing multi-rolls each roll comprising a fillet of coated wires according to the invention.

Referring to FIG. 7, an illustration is shown of an alternate embodiment of a finishing machine 50 according to the invention employing multi-rolls 56, 62, 68, 74 which are capable of rotating in either direction for processing fabric in either direction. The multi-rolls 56, 62, 68 and 74 are positioned in line and parallel to each other. Each of the multi-rolls 56, 62, 68, 74 comprises an abrasively coated wire fillet 52 attached thereto. The wire fillet 52 is the same as the coated wire fillet 26 attached to the cylinder 24 in FIG. 1. When the direction of the multi-rolls 56, 62, 68, 72 is reversed, the wrapping of the fillet 52 on each of the multi-rolls has to be reversed.

Pairs of idlers 54 and 58, 60 and 64, 66 and 70, 72 and 76 are located on either side of each roll 52, 62, 68 and 74 respectively. The purpose of the driver roll 56 is to brush against the fabric 12 passing by roll 56 causing a soft finish such as a suede tone to be produced on the fabric 12. The fabric then passes by the other driven rolls 62, 68 and 74 each having a wire fillet similar to the wire fillet 52. Each of the multi-rolls 56, 62, 68, 74 provides for gradual control of the suede effect on the fabric 78. A fixed position idler 53 guides the fabric 12 up over idler 54 and positions the fabric 12 for contact with the wire fillet 52 on the driver roll 56. An idler 58 on the opposite side of driver roll 56 relative to idler 54 is adjustable for determining the amount of fabric contact made with the wire surface of roll 56. The idlers support or transport the fabric. The idlers on the sides of the other rolls 62, 68, 74 perform the same functions. The finished fabric 78 exits the multi-roll finishing machine 50 to a take-up roll (not shown).

A multi-roll finishing machine which performs a sueding function similar to finishing machine 50 may be embodied by Model PM/88 and manufactured by Comet S.P.A. of Prato, Italy. The wire fillets for the multi-rolls may be embodied by Model F100 manufactured by Redman Card Clothing, Co., Inc. of Andover, Mass.

Figure 8A:
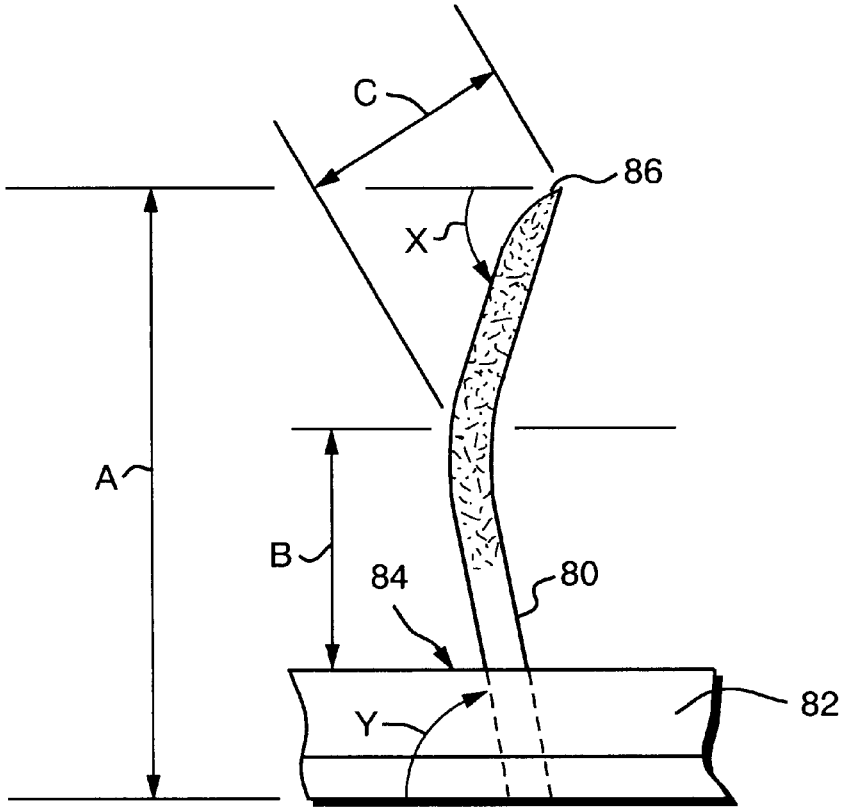
FIG. 8A is a side view of an enlarged coated wire for napping, extending from a fillet for use in a napper finishing machine according to the invention.
Figure 8B:
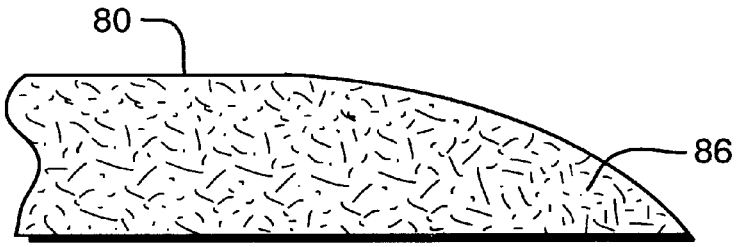
FIG. 8B is a side view of an enlarged scale of the point of the napping wire shown in FIG. 8A described as a needle point.

Referring now to FIG. 8A and FIG. 8B, FIG. 8A is a side view of an alternate enlarged coated wire 80 for napping extending through and above the base 82 of a fillet 84, and FIG. 8B shows an enlarged side view of the point of the wire 80 in FIG. 8A which is generally referred to as a needle point. Other points are used on napping wire to obtain various finishes such as half needle, chisel point, or bump, mushroom or hammerhead points. The specifications for the coated napper wire of FIG. 8A are defined in the following table and such specifications may be varied depending on the fabric and the desired finish:

TABLE 2

| SPECIFICATIONS OF NAPPING WIRE FOR FILLET | |
|---|---|
| PITCH OR ANGLE OF WORKING (X): | 45 Degrees |
| SLANT OR ANGLE OF SETTING (Y): | 80 Degrees |
| HEIGHT OF WIRE (A): | 0.443 inches |
| HEIGHT OF BEND (B): | 3/16 inches |
| DIAMETER OF WIRE (D): | 0.016 inches |
| CROSS-SECTIONAL SHAPE OF WIRE: | Round |
| DENSITY OF WIRE POINTS: | 350 points per square inch |

The alternate coated wire 80 is used for napping fabrics which is the function of raising, fraying or cutting fibers to create a fuzzy or napped surface. The coated wire 80 for napping provides a higher pile with less lint occurring during the process; also, napping efficiency is improved because the napping coated wires 80 last much longer before needing to be replaced. The cross-sectional shape of the napping wires in FIG. 8A is round; The point 86 of coated wire 80 is tapered as shown in FIG, 8B and referred to as a needle point. However, one of ordinary skill in the art will recognize that other shapes are used for napping wire such as diamond or rhombic shape, elliptical, triangular or rectangular with rounded corners.

Figure 9:
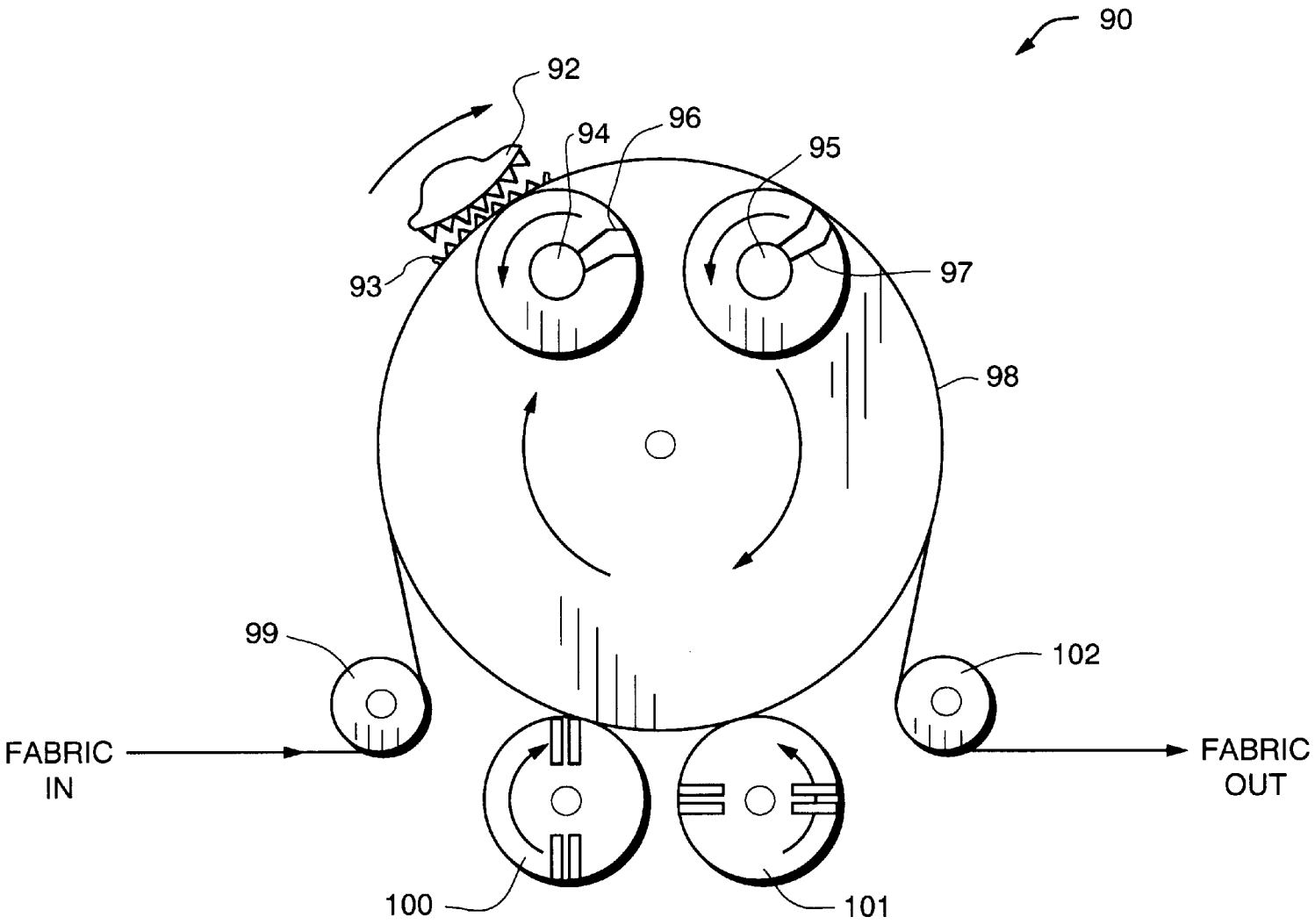
FIG. 9 illustrates a napping machine comprising a plurality of rolls having coated wire fillets covering each roll.

Referring now to FIG. 9, an illustration of a double acting napper finishing machine is shown comprising a plurality of rolls such as pile rolls 94 and counter pile roll 95, each of the rolls being covered with coated wire fillets 96, 97. Typically there would be 12 pile rolls and 12 counter-pile rolls alternately positioned. The rolls 95, 97 are positioned around the periphery of a cylinder 98 which rotates in a clockwise direction whereas the rolls 94, 95 rotate in a counter clockwise direction. The angled end, coated wires of the fillet 96 point in a clockwise direction and the angled end, coated wires of fillet 97 point in a counter clockwise direction. Idlers 99 and 102 guide a fabric IN and OUT respectively of the double acting machine 90. A front fancy 100 cleans the counter-pile rolls and a rear fancy 101 cleans the pile rolls. Also shown in the illustration of FIG. 9 are an internal gear 92 for controlling the cylinder 90 rotation and a worker roll gear 93 for controlling the worker rolls 94, 95. Such a double acting napper finishing machine may be embodied by a 24-roll napper made by RFG Enterprises, Inc. of Canover, N.C. 28613. Other napping machines include a single acting napper and a knit goods napper which are readily known to one of ordinary skill in the art.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A method for providing a soft finish on a fabric comprising the steps of:

feeding a fabric into a finishing machine;

moving said fabric over a first driven means rotating in a first direction;

providing a second driven means rotating in a second direction adjacent to said first driven means;

attaching an abrasively coated wire means to said second driven means;

adjusting said moving fabric to be in contact with said abrasively coated wire means; and cutting surface fibers of said fabric with said abrasively coated means as said fabric passes between said first driven means and said second driven means.

2. The method as recited in claim 1 wherein said step of feeding a fabric into a finishing machine includes the step of providing tension on said fabric for constant surface contact with said abrasively coated wire means.

3. The method as recited in claim 1 wherein said step of moving said fabric over said first driven means includes the step of covering said first driven means with a rubber face foundation to provide a frictional, cushioned surface.

4. The method as recited in claim 1 wherein said step of cutting surface fibers of said fabric with said abrasively coated wire means comprises the step of providing each wire of said wire means with a tungsten carbide coating.

5. The method as recited in claim 1 wherein said step of adjusting said moving fabric to be in contact with said abrasively coated wire comprises the step of moving said first driven means toward or away from said second driven means.

6. The method as recited in claim 1 comprises the step of brushing cut fibers from said fabric as said fabric moves away from said first driven means and said second driven means.

7. The method as recited in claim 6 comprises the step of guiding said fabric to a take-up roll following said step of brushing cut fibers.

8. The method as recited in claim 1 wherein said step of moving said fabric over a first driven means rotating in a first direction comprises the step of a roll rotating in a clockwise direction.

9. The method as recited in claim 1 wherein said step of providing a second driven means rotating in a second direction comprises the step of a cylinder rotating in a counterclockwise direction.

10. The method as recited in claim 1 wherein said step of attaching an abrasively coated wire means to said second driven means includes the step of attaching a fillet around said second driven means having a plurality of abrasively coated wires extending through a flexible base.

11. The method as recited in claim 1 wherein said fabric exiting from said finishing machine comprises a suede finish.

12. The method as recited in claim 1 wherein said step of feeding a fabric into a finishing machine includes the step of feeding a denim fabric into said finishing machine for producing a soft, washed or faded finish.

13. In a finishing machine for producing a soft finish on a fabric the improvement comprising:

first driven means for drawing said fabric into said finishing machine; and second driven means, positioned adjacent to said first driven means, for providing a finishing means, said finishing means comprises an abrasively coated wire means attached thereto for producing said soft finish on said fabric.

14. The finishing machine as recited in claim 13 wherein said abrasively coated wire means comprises a fillet having a plurality of wires, each of said wires being coated with a tungsten carbide coating.

15. A method of using wires for raising pile surfaces on a fabric in a finishing machine comprising the steps of:

providing a fillet having a plurality of said wires extending from a flexible base, each of said wires having an angularly offset extremity;

coating said wires with an abrasive material; and attaching said abrasively coated wire fillet to said machine for finishing fabric with said pile surfaces on said fabric.

16. The method as recited in claim 15 wherein said method comprises the step of providing each of said abrasively coated wires with a round profile.

17. The method as recited in claim 15 wherein said method includes producing a suede surface on said fabric.

18. The method as recited in claim 15 wherein said step of providing a fillet having a plurality of wires comprises the step of providing said angularly offset extremity with a slant angle of approximately eighty degrees.

19. The method as recited in claim 15 wherein said step of coating said wires extending from said fillet comprises the step of spraying a tungsten carbide material on said wires.

20. The method as recited in claim 19 wherein said step of spraying said wires comprises the steps of:

using an arc spray gun means for coating said wires;

loading thermal spray wire into said arc spray gun means, said thermal spray wire comprises said tungsten carbide material;

pointing said spray gun at said wires a predetermined distance from said wires; and activating said spray gun means.

21. The method as recited in claim 15 wherein said finishing machine of said method includes a napper.

22. The method as recited in claim 15 wherein said method comprises the step of providing said abrasively coated wires with a predetermined geometric profile for obtaining a predetermined pile surface on said fabric.

23. The method as recited in claim 22 wherein said step of providing said abrasively coated wires having a predetermined geometric profile for obtaining a predetermined pile surface on said fabric comprises the step of raising loops on said fabric.

24. The method as recited in claim 22 wherein said step of providing said abrasively coated wires having a predetermined geometric profile for obtaining a predetermined pile surface on said fabric comprises the step of breaking loops on said fabric.

25. The method as recited in claim 22 wherein said step of providing said abrasively coated wires having a predetermined geometric profile for obtaining a predetermined pile surface on said fabric comprises the step of producing a fleeced finish on said fabric.

26. In a finishing machine for raising a pile surface on a fabric, the improvement comprising:

a fillet having a plurality of wires extending from a flexible base, each of said wires having an angularly offset extremity;

each of said plurality of wires having an abrasive material coated thereon;

roll means for providing a surface for wrapping said fillet around; and means for drawing and positioning an unfinished fabric in contact with said abrasively coated wire fillet to produce said pile surface.

27. The machine as recited in claim 26 wherein each of said plurality of wires has a round profile.

28. The finishing machine as recited in claim 26 wherein said pile surface on said fabric comprises a suede finish.

29. The finishing machine as recited in claim 26 wherein each of said plurality of wires in said fillet comprises said angularly offset extremity with a slant angle of approximately eighty degrees.

30. The finishing machine as recited in claim 26 wherein each of said abrasive material coated wires comprises a coating of tungsten carbide material.

31. The finishing machine as recited in claim 26 includes a napper finishing machine.

32. The finishing machine as recited in claim 26 wherein said plurality of abrasively coated wires comprises a predetermined geometric profile for obtaining said pile surface on said fabric.

33. The finishing machine as recited in claim 32 wherein said pile surface on said fabric comprises raised loops.

34. The finishing machine as recited in claim 32 wherein said pile surface on said fabric comprises broken loops.

35. The finishing machine as recited in claim 32 wherein said pile surface comprises a fleeced finish.

* * * * *

UNITED STATES PATENT AND TRADEMARK OFFICE

CERTIFICATE OF CORRECTION

PATENT : 5,956,824

DATED : September 28, 1999

INVENTOR(S) : Charles F. Redman

It is certified that error appears in the above-identified patent and that said Letters Patent is hereby corrected as shown below:

On the title page, item [54] should read as follows:

--METHOD AND APPARATUS FOR SURFACE FINISHING FABRIC WITH COATED WIRES--.

Signed and Sealed this

Twenty-first Day of March, 2000

*Attest:*

*Attesting Officer*

Q. TODD DICKINSON

*Commissioner of Patents and Trademarks*

UNITED STATES PATENT AND TRADEMARK OFFICE

CERTIFICATE OF CORRECTION

PATENT : 5,956,824

DATED : September 28, 1999

INVENTOR(S) : Charles F. Redman

It is certified that error appears in the above-identified patent and that said Letters Patent is hereby corrected as shown below:

Column 8, line 2, "90" should read --98--.
Column 8, line 29, after "coated" insert --wire--.
Column 8, line 45, after "wire" insert --means--.
Column 8, line 57, delete "a roll rotating" and insert --rotating a roll--.
Column 8, line 61, delete "a cylinder rotating" and --insert --rotating a cylinder--.
Column 9, line 50, after "gun" insert --means--.
Column 10, lines 25, delete "coated" and insert --coating--.

Signed and Sealed this

Ninth Day of May, 2000

*Attest:*

Q. TODD DICKINSON

*Attesting Officer*

*Director of Patents and Trademarks*